US005651701A

United States Patent [19]

Chen

[11] Patent Number: 5,651,701

[45] Date of Patent: Jul. 29, 1997

[54] ELECTRICAL COMPUTER CONNECTOR FOR CONNECTION BETWEEN COMPUTER I/O PORT AND TELECOMMUNICATION CABLE

[76] Inventor: Michael Chen, No. 11, Alley 16, Lane 337, Sec. 1, Ta Tung Rd., Hsi Chin Chen, Taipei Hsien, Taiwan

[21] Appl. No.: 633,417

[22] Filed: Apr. 17, 1996

[51] Int. Cl.[6] ..... H01R 13/648

[52] U.S. Cl. ..... 439/607; 439/638; 439/676

[58] Field of Search ..... 439/607, 608, 439/609, 610, 638, 650, 653, 655, 687, 696, 731, 676

[56] References Cited

U.S. PATENT DOCUMENTS 5,162,000 11/1992 Frantz ..... 439/607
5,383,795 1/1995 Falossi et al. ..... 439/638
5,480,326 1/1996 Chen ..... 439/607

*Primary Examiner*—Khiem Nguyen
*Assistant Examiner*—Yong Ki Kim
*Attorney, Agent, or Firm*—Bacon & Thomas

[57] ABSTRACT

An electrical computer connector which includes a module plug connected to a telephone cable at one end and covered with a metal ground shield, a plastic outer shell having a front opening and a rear opening, a D-type connector mounted in the rear opening of the plastic outer shell and adapted for connection to the I/O port of a computer, a module jack mounted in the front opening of the plastic outer shell and connected to the contact pins of the D-type connector by conductors and adapted for the connection of the module plug, and a metal shield mounted within the plastic outer shell and covered around the module jack and the D-type connector to form with the tubular outer conductor of the telephone cable and the metal casing of the D-type connector into a ground loop to eliminate electromagnetic interference.

2 Claims, 5 Drawing Sheets

ELECTRICAL COMPUTER CONNECTOR FOR CONNECTION BETWEEN COMPUTER I/O PORT AND TELECOMMUNICATION CABLE

BACKGROUND OF THE INVENTION

The present invention relates to electrical computer connectors adapted for connection between the I/O port of a computer and a telephone cable which has metal shield means to effectively eliminate electromagnetic interference.

Various electrical connecting devices have been disclosed for the purpose of connecting a computer peripheral apparatus (such as printer, modem, etc.) to the I/O port of a computer. Exemplars of these electrical connecting devices are seen in U.S. Pat. No. 4,961,711, entitled "ELECTRICAL CONNECTOR"; U.S. Pat. No. 4,936,793, entitled. "LOCKING DEVICE FOR CONNECTOR". These devices simply use a plastic outer shell to protect the internal circuit. Therefore, they cannot eliminate electromagnetic interference. The design of U.S. Pat. No. 5,192,226, entitled "DOUBLE-OUTPUT PORT CABLE ASSEMBLY FOR NOTEBOOK COMPUTERS" teaches the use of an aluminum foil covering to eliminate electromagnetic interference. The aluminum foil covering is covered around the electric circuit, and then a plastic outer shell is injection-molded on the aluminum foil. This type of double-output port cable assembly is complicated and expensive to manufacture. If an electrical connector which is made according to this method has a jack for the connection of a telephone cable plug, outside electromagnetic waves may pass through the jack to interfere with the internal signal transmission of the connector.

SUMMARY OF THE INVENTION

The present invention has been accomplished to provide an electrical computer connector which eliminates the aforesaid problem. According to one aspect of the present invention, the electrical computer connector comprises a module plug connected to a telephone cable at one end and covered with a metal ground shield, a plastic outer shell having a front opening and a rear opening, a D-type connector mounted in the rear opening of the plastic outer shell and adapted for connection to the I/O port of a computer, a module jack mounted in the front opening of the plastic outer shell and connected to the contact pins of the D-type connector by conductors and adapted for the connection of the module plug, and a metal shield mounted within the plastic outer shell and covered around the module jack and the D-type connector to form with the tubular outer conductor of the telephone cable and the metal casing of the D-type connector into a ground loop to eliminate electromagnetic interference, According to another aspect of the present invention, the metal shield and the metal ground shield are respectively made from metal by stamping and bending for quick installation. According to still another aspect of the present invention, the metal shield is comprised of a front shield covered around the module jack, and a rear shield covered around a part of the D-type connector, wherein the rear shield is shaped like a short, rectangular tube having a plurality of flanges at one end respectively clamped on the metal casing of the D-type connector.

DETAILED DESCRIPTION OF THE PREFERRED EMBODIMENT

Figure 1:
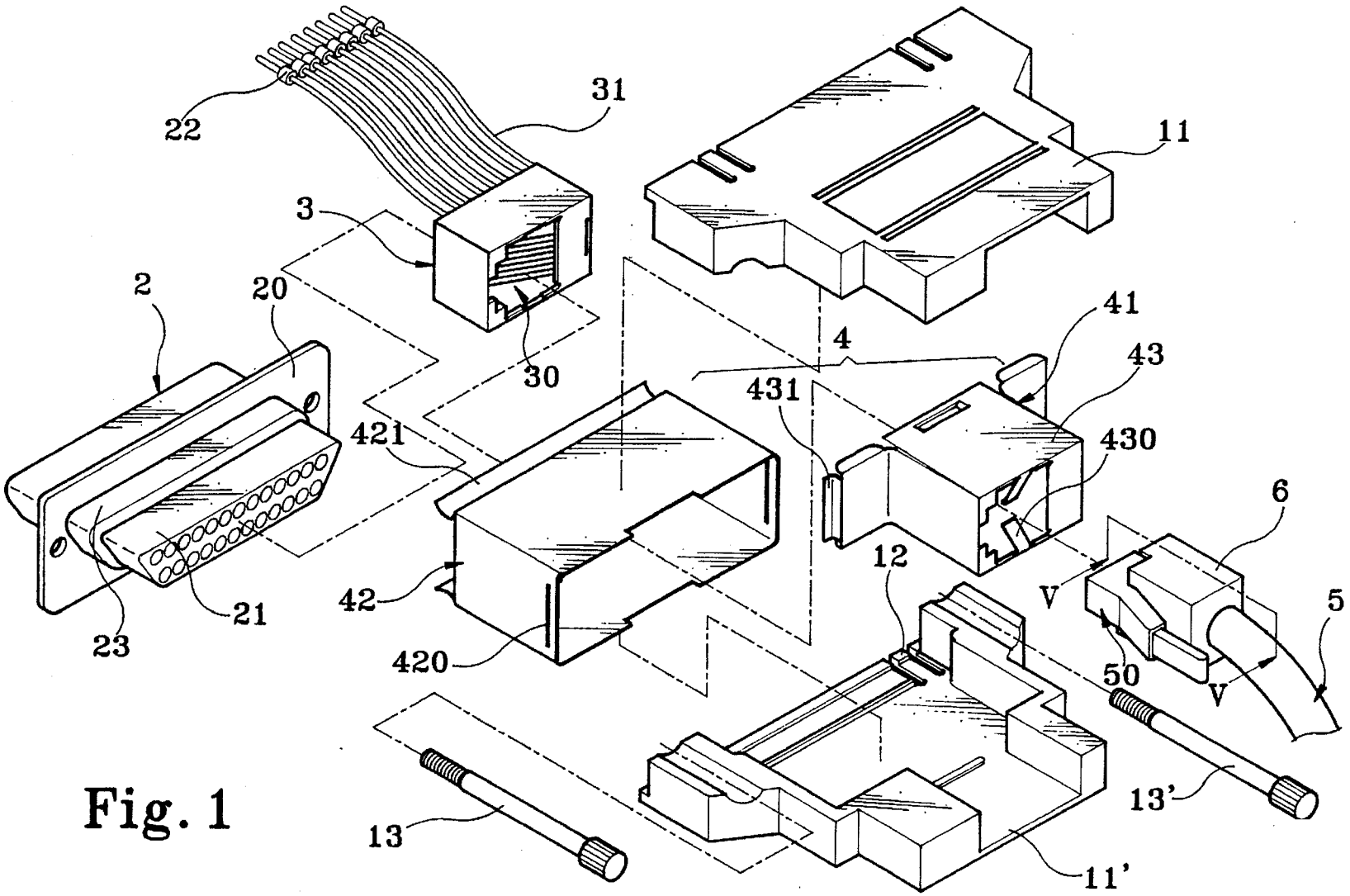
FIG. 1 is an exploded view of an electrical computer connector according to the present invention.
Figure 2:
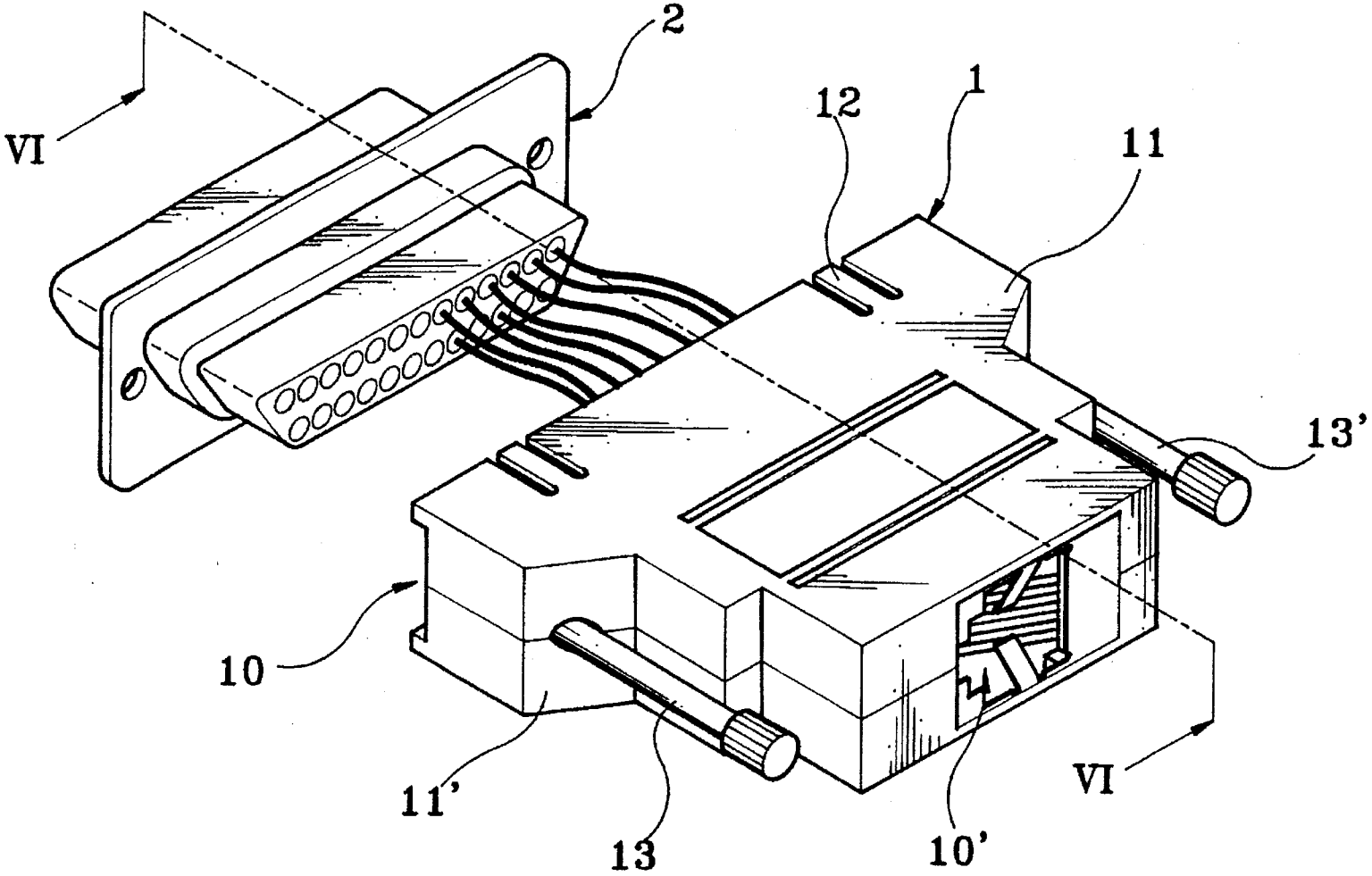
FIG. 2 is an elevational of the electrical computer connector shown in FIG. 1.

Referring to FIGS. 1 and 2, an electrical computer connector in accordance with the present invention comprises a plastic outer shell 1 having a rear opening 10 and a front opening 10' axially aligned at two opposite ends, a D-type connector 2 and a module jack 3 respectively mounted in the openings 10, 10' of the plastic outer shell 1, a metal shield 4, and a metal ground shield 6 covered around the module plug 50 of the telephone cable 5. The plastic outer shell 1 is comprised of a upper shell 11 and a bottom shell 11' heat-sealed or adhered together. Two mounting screws 13, 13' are bilaterally mounted in the plastic outer shell 1 for fastening to the computer. The plastic outer shell 1 has a plurality of opposing hooks 12 in the rear opening 10 adapted to hook on the outward metal flange 20 of the D-type connector 2. The D-type connector 2 can have 9 Pin, 15 Pin, or 25 Pin as desired. The D-type connector 2 shown in FIG. 1 is a 25 Pin connector. As illustrated, the D-type connector 2 comprises a metal casing 23 adapted for connection to the ground terminal of the computer, an outward flange 20 raised around the metal casing 23 and secured to the front opening 10 of the plastic outer shell 1 by the opposing hooks 12, an insulative core 21 mounted within the metal casing 23, and a plurality of contact pins 22 axially mounted in the insulative core 21 and adapted for electrical connection to the I/O port of the computer. The module jack 3 has a plug hole 30 adapted for the connection of the module plug 50 of the telephone cable 5, and a plurality of conductors 31 respectively connected to the contact pins 22 of the D-type connector 2.

Figure 3A:
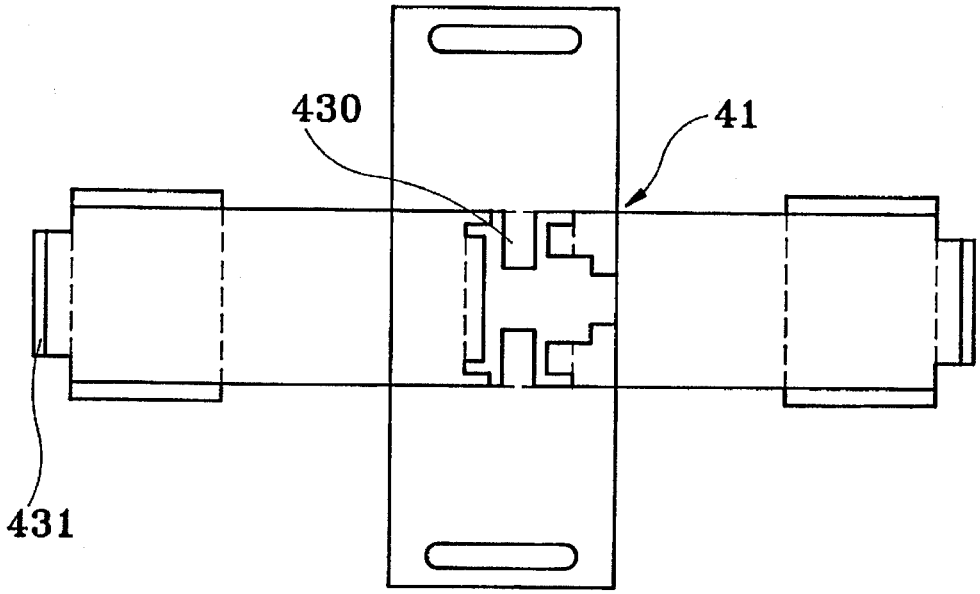
FIG. 3A is an extended out view of the front shield of the metal shield shown in FIG. 1 (the dotted lines are bending lines)
Figure 3B:
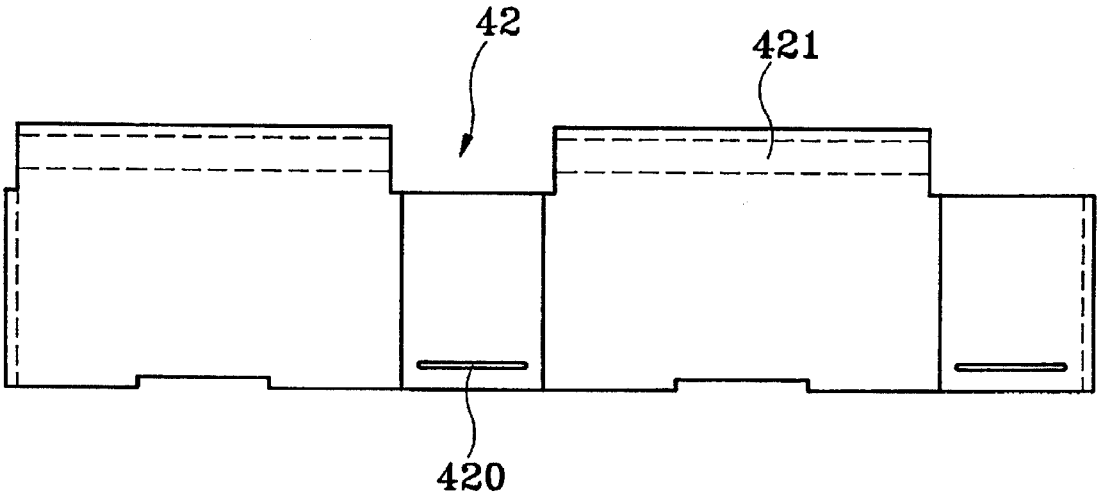
FIG. 3B is an extended out view of the rear shield of the metal shield shown in FIG. 1 (the dotted lines are bending lines)

Referring to FIG. 3 and FIG. 1 again, the metal shield 4 eliminates electromagnetic interference, comprised of a front shield 41 and a rear shield 42 respectively made by bending the metal plates shown in FIGS. 3A and 3B into shape. The front shield 41 comprises a body 43 covered around the module jack 3 without blocking the plug hole 30, two projecting strips 430 raised from the front end of the body 43 at two opposite locations and inserted into the plug hole 30 of the module jack 3 and disposed in contact with the ground shield 6, and two side wings 431 raised from the rear end of the body 43 at two opposite sides and fastened to the front opening 420 of the rear shield 42. The rear shield 42 is shaped like a short, rectangular tube having a front opening 420 adapted for the mounting of the side wings 431 of the front shield 41, and two rear flanges 421 covered over the metal casing 23 of the a D-type connector 2. When the module jack 3 is inserted into the body 43 of the front shield 41 and electrically connected to the D-type connector 2, the metal shield 4 is mounted in the plastic outer shell 1. When assembled, the metal shield 4 effectively eliminates the interference of outside electromagnetic noises, and prohibits high-frequency signal from escaping out of the electrical computer connector.

Figure 4:
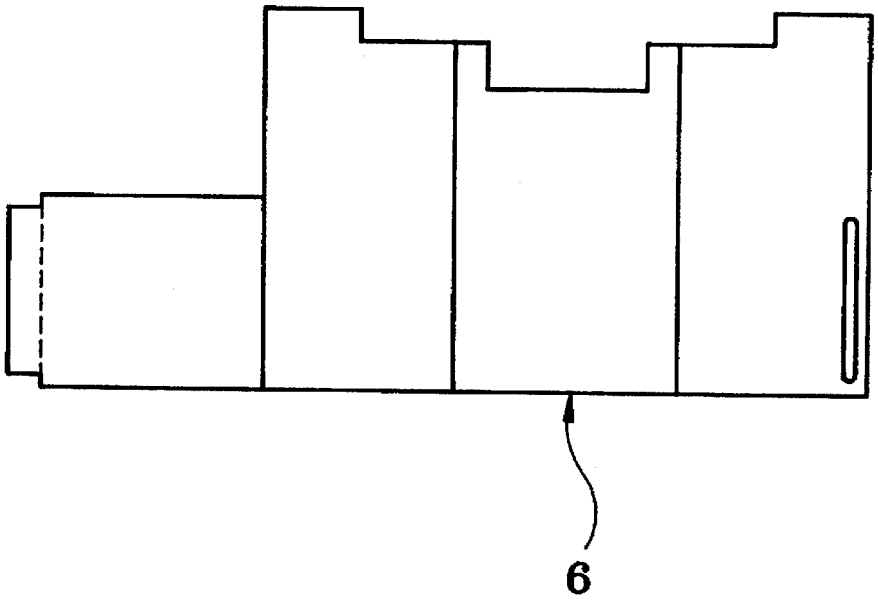
FIG. 4 is an extended out view of the ground shield shown in FIG. 1 (the dotted lines are the bending lines)
Figure 5:
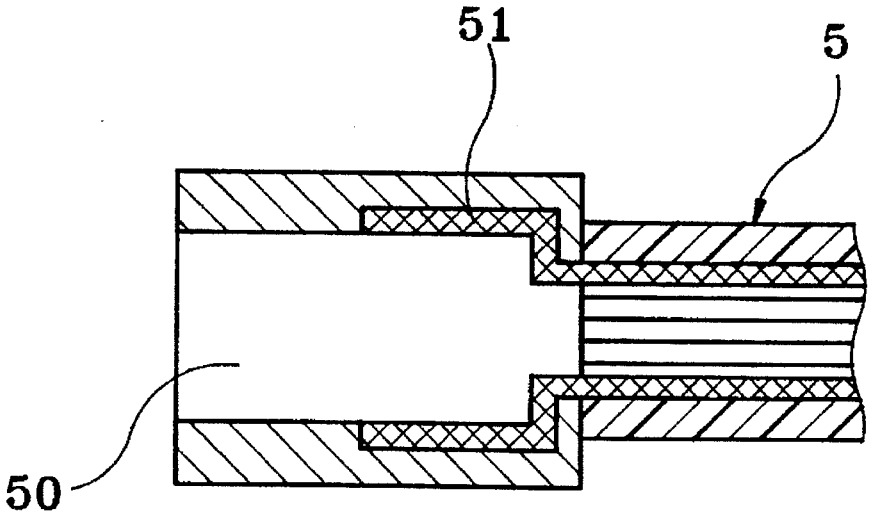
FIG. 5 is a sectional view taken along line V—V of the module plug shown in FIG. 1.
Figure 6:
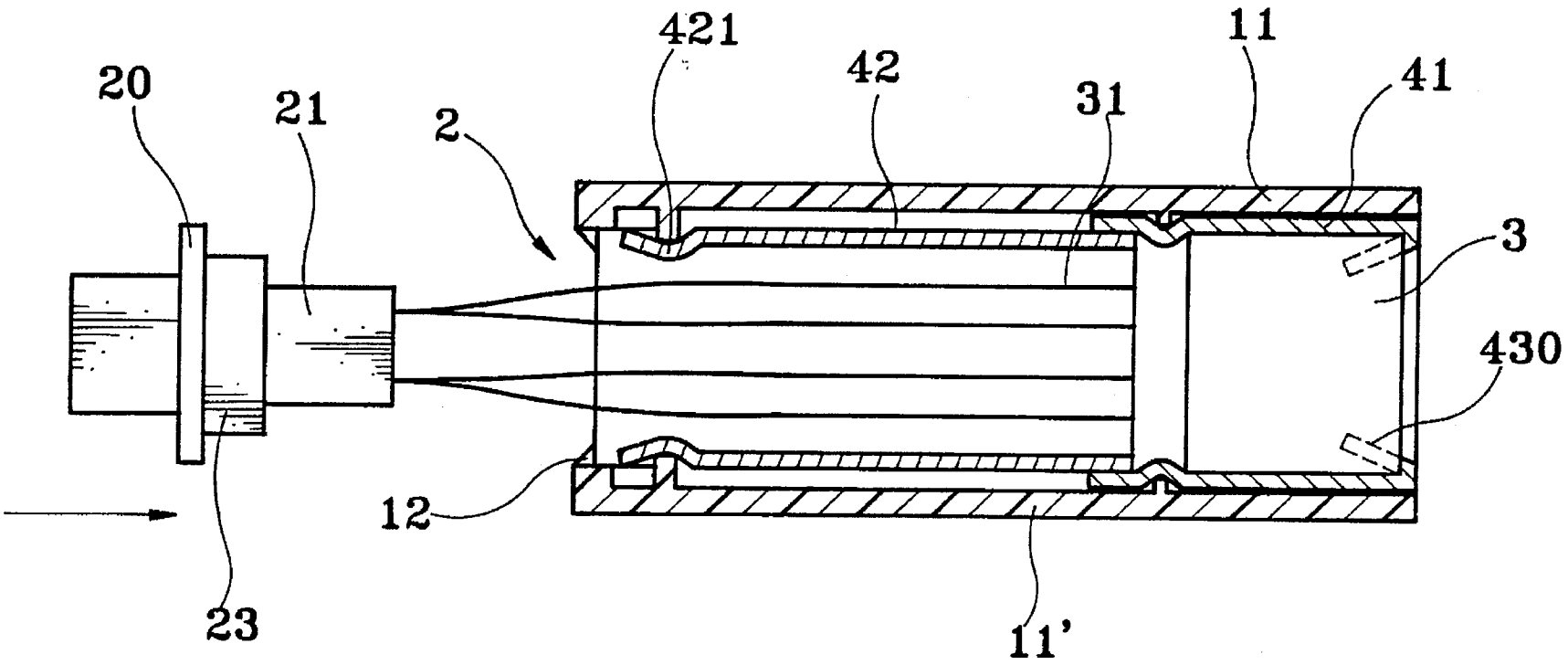
FIG. 6 is a sectional view taken along line VI—VI of FIG. 2.

Furthermore, in order to protect the module plug 50 of the telephone cable 5 against the interference of outside electromagnetic noises, the aforesaid metal ground shield 6 is installed and covered around the module plug 50. The metal ground shield 6 is made from a metal plate by stamping and bending (see FIG. 4). When the metal ground shield 6 is installed, it clamps on the tubular outer conductor 51 of the telephone cable 5. Therefore, the tubular outer conductor 51, the metal ground shield 6, the metal shield 4, and the D-type connector 2 form a ground loop to effectively eliminate electromagnetic interference.

I claim:

1. An electrical computer connector adapted for connection between an I/O port of a computer and a telephone cable, comprising:

a module plug connected to a telephone cable at one end and covered with a metal ground shield, said metal ground shield clamping on a tubular outer conductor of the telephone cable;

a plastic outer shell consisting of a upper shell and a bottom shell fastened together, said plastic shell having a front opening and a rear opening axially aligned at two opposite ends;

a D-type connector mounted in the rear opening of said plastic outer shell for connection to the I/O port of a computer, said D-type connector comprising a metal casing, an outward flange raised around said metal casing, an insulative core mounted within said metal casing, and a plurality of contact pins axially mounted in said insulative core;

a module jack mounted in the front opening of said plastic outer shell, said module jack having a plug hole adapted for the connection of said module plug electrically, and a plurality of conductors respectively connected to the contact pins of said D-type connector; and a metal shield mounted within said plastic outer shell and covered around said module jack and said D-type connector to eliminate electromagnetic interference, said metal shield comprising a front shield and a rear shield, said front shield comprising a body covered around said module jack without blocking its plug hole, two projecting strips raised from said body at one end at two opposite locations and inserted into the plug hole of said module jack for the contact of said ground shield, two side wings bilaterally raised from said body at an opposite end fastened to one end of said rear shield, said rear shield being shaped like a short, rectangular tube having a plurality of flanges at one end respectively clamped on the metal casing of said D-type connector.

2. The electrical computer connector of claim 1 wherein said plastic outer shell comprises a plurality of opposing hooks respectively disposed in the rear opening and hooked on the outward flange of the metal casing of said D-type connector.

* * * * *